US005320083A

United States Patent [19]

Brelsford

[11] Patent Number: 5,320,083

[45] Date of Patent: Jun. 14, 1994

[54] ARCHERY BOW WITH TRANSPARENT RISER

[76] Inventor: Harry W. Brelsford, 233 E. Carrillo St., Ste. C., Santa Barbara, Calif. 93101

[21] Appl. No.: 746,798

[22] Filed: Aug. 13, 1991

Related U.S. Application Data

[63] Continuation of Ser. No. 497,652, Mar. 23, 1990, abandoned.

[51] Int. Cl.[5] ..... F41B 5/00

[52] U.S. Cl. ..... 124/23.1; 124/88; 124/24.1; 124/25.6

[58] Field of Search ..... 124/87, 88, 86, 23.1, 124/24.1, 25, 25.6, 1; 33/265

[56] References Cited

U.S. PATENT DOCUMENTS

| | | | |
|---|---|---|---|
| 1,608,765 | 11/1926 | Bevier . | |
| 1,847,593 | 3/1932 | Cameron . | |
| 2,344,799 | 3/1944 | Brown et al. . | |
| 2,689,559 | 9/1954 | Meyer | 124/24.1 |
| 2,802,461 | 8/1957 | Vance | 124/24.1 X |
| 2,979,049 | 4/1961 | Jones | 124/23.1 |
| 3,120,222 | 2/1964 | Bear | 124/87 X |
| 3,136,063 | 6/1964 | Stebbins | 124/87 |
| 3,455,288 | 7/1969 | Knerr | 124/24.1 X |
| 3,526,037 | 9/1970 | Crosby | 33/265 |
| 3,921,598 | 11/1975 | Helmick | 124/23.1 |
| 4,122,821 | 10/1978 | Mamo | 124/23.1 |
| 4,167,333 | 9/1979 | Young et al. | 33/265 X |
| 4,375,725 | 3/1983 | Orlob | 33/265 X |
| 4,481,717 | 11/1984 | Kowalski | 124/87 X |
| 4,716,880 | 1/1988 | Adkins | 124/25 |
| 4,759,337 | 7/1988 | Suski . | |
| 4,819,611 | 4/1989 | Sappington | 124/87 |
| 4,967,478 | 11/1990 | Sherman | 33/265 |

*Primary Examiner*—Randolph A. Reese
*Assistant Examiner*—Harry C. Kim

[57] ABSTRACT

An archery bow has the sighting area formed of transparent material so that there is no obstruction in the field of view when aiming the arrow. The forward and rear surfaces are preferably flat and parallel to maximize the clarity of view through the transparent material.

5 Claims, 1 Drawing Sheet

ARCHERY BOW WITH TRANSPARENT RISER

This is a continuation of copending application(s) Ser. No. 07/497,652 filed on Mar. 23, 1990, now abandoned.

This invention relates to archery bows and has particular reference to a bow having a transparent riser so that the archer can look through the riser to obtain an uninterrupted field of view.

BACKGROUND OF PRIOR ART

When using an ordinary bow, the sighting area is just above the hand grip. This sighting part of the bow being opaque, obscures the view of a wide angle of the field of view. While this is not serious for shooting at stationary targets, it presents a serious obstruction of view for a hunting archer. Various attempts have been made to reduce this obscurity. For example, U.S. Pat. No. 4,759,337 shows spaced sheet metal plates as forming the center part of the bow, with sighting between the plates. Various other shapes of apertures and plates for strengthening the bow at the riser have been made. All of these structures leave a greater or lesser amount of obscurity that interferes with the field of view.

BRIEF DESCRIPTION OF THE INVENTION

I solve this problem of obscuring the field of view by making the sighting part of the bow of high strength transparent material such as tempered glass, methyl methacrylate resin, polycarbonate, polystrene and other transparent materials having a satisfactory index of refraction. The front and rear surfaces of the riser are parallel and optically flat and the right and left sides of the riser are also flat and are angled with the angle of sight of the archer at full draw on the bow. There is a clear, unobstructed field of view for the archer. If desired this transparent area can be extended into the line of sight area of the bow and dots can be pasted or otherwise adhered to the transparent material to indicate sighting of 20 yards, 30 yards, 40 yards etc.

DESCRIPTION OF FIGURES

In the drawings forming an integral part of this specification

DETAILED DESCRIPTION OF THE INVENTION

Figure 1:
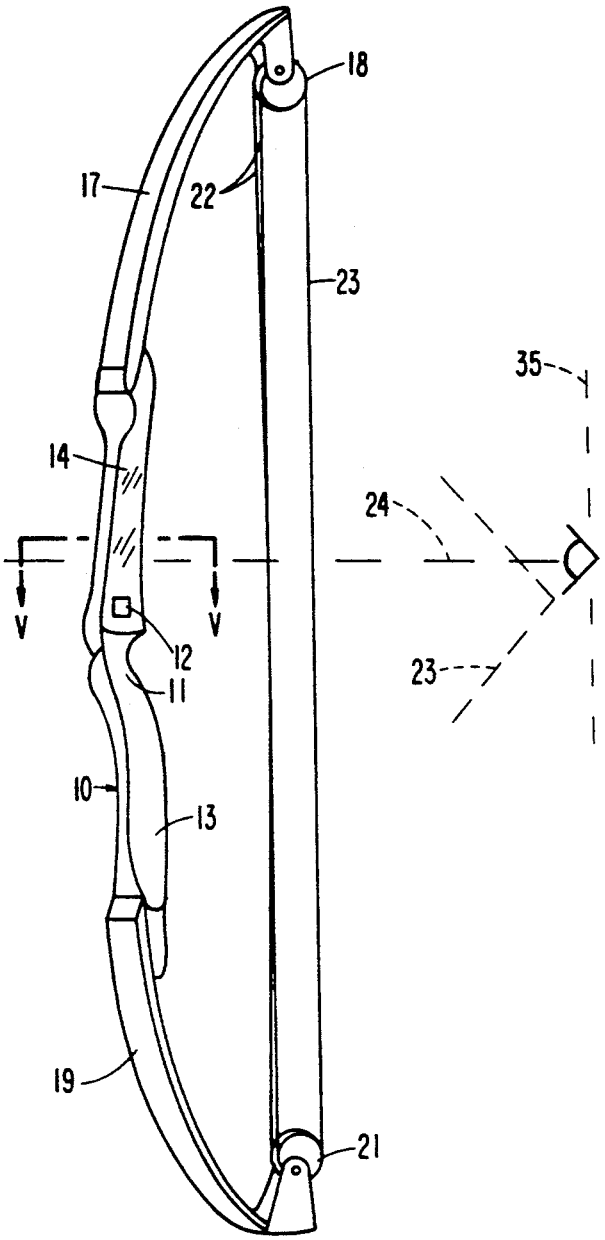
FIG. 1 is a quartering view of a compound bow embodying the invention and illustrating the sighting area of the bow.

Illustrated in FIG. 1 is a compound bow 10 for right handed archers showing a hand grip 11, an arrow rest 12, and a lower shank 13. Above the hand grip 11 is riser 14 which is the sighting area of the bow which is viewed by the archer's eye 16 while aiming.

As used in this specification, the word "riser" describes an integral structural part of a bow that carries the full stress of the drawn bow. The shooter's line of sight to a target generally passes near this riser section of a bow which is above the hand grip portion of the bow. Adjustably secured to the upper end of riser 14 is an upper flexible limb 17 on which are mounted eccentric wheels 18. Secured to the lower end of shank 13 is a lower limb 19 on which are mounted eccentric wheels 21. Wrapped on the eccentric wheels 18 are actuating cables 22 and a bow string 23. Disposed adjacent to the archers eye 16 is the bow string 23 (in broken lines) shown in its retracted position as when the archer is sighting along the broken line 24 for his target. The position of this line of sight varies with the distance to the target as the bow is elevated for more distant targets.

Figure 2:
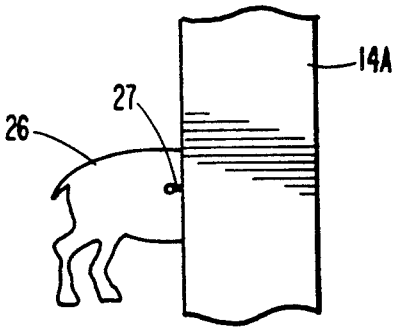
FIG. 2. PRIOR ART
FIG. 2 is an elevation view of a segment of a prior art riser showing the target obscured.
Figure 3:
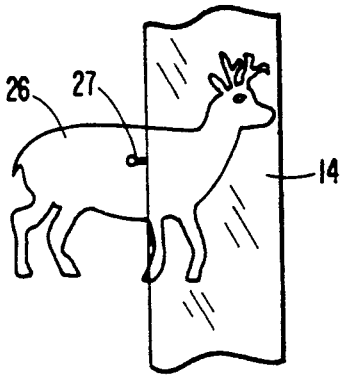
FIG. 3 is an elevation view on an enlarged scale of the transparent riser of FIG. 1 showing an animal viewed without obstruction.

Illustrated in FIG. 2 is the prior art view of a target animal 26 with the bow held so that a target pin 27 is at the target place on the animal. The entire forward part of the animal is obscured by the opaque riser 14 A.

Illustrated in FIG. 2, by way of contrast, is the same animal 26 as viewed through my transparent riser 14 and the archer will obtain a fuller view of the animal 26. If the hunter is limited to a particular sex or horn size of the animal, this fuller view will be of great value. For moving targets the absence of an opaque area in the field of view greatly assists the archer in aiming at a target.

Figure 4:
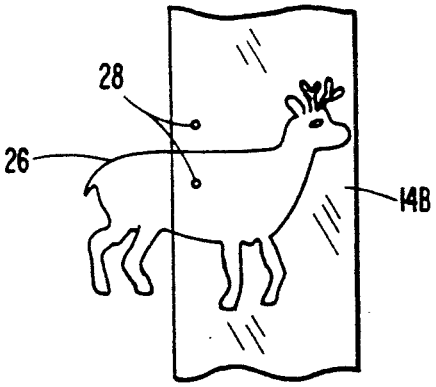
FIG. 4 is an elevation view of a modified form of the invention wherein the transparent riser is widened to include the line of sight area and sighting dots are applied to the riser.

Illustrated in FIG. 4 is a modified form of the invention wherein a transparent riser 14 B is widened horizontally into the line of sight of the archer. This makes possible the placement of dots 28 on either the front or rear surface of the riser 14 B. Dots 28 or other indicia can be placed for different distances to a target, for example 20 yards, 30 yards, 40 yards etc.

Figure 5:
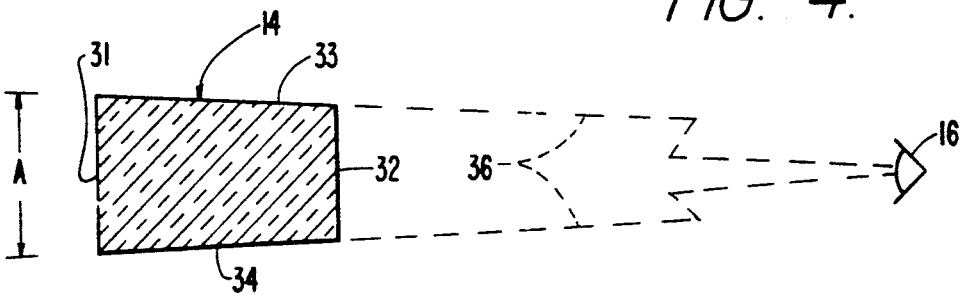
FIG. 5 is a sectional view on an enlarged scale along the line V—V of FIG. 1 showing the trapezoidal shape of the riser that eliminates edge lines as viewed by the archer.

Illustrated in FIG. 5 is a sectional view of the riser 14 along the lines V—V of FIG. 1. The riser has a front surface 31 which is parallel to a rear surface 32. Both surfaces are preferably optically flat or sufficiently flat so that the viewer has an undistorted field. The riser 14 has side surfaces 33 and 34 which are preferably not parallel and instead are tapered so that they align with the lines of sight 36 of the archers eye 16 when the bow is at full draw as indicated by the bow string broken line 23 of FIG. 1. Technically, the flat sides 33 and 34 intersect a generally vertical line 35 located at the viewer's eye 16. The lines 36 form an angle A at full draw. This geometry for the sidewalls eliminates any outline of the riser 14 in the eye 16 of the archer and the sidewalls are not seen by the archer. These sidewalls 33 and 34 are preferably sufficiently optically flat so that the visual effect described is achieved.

Presently the rigid part of an archery bow (items 11, 13 and 14) is made from magnesium or other light weight material. Many are formed by molding or casting and my transparent bow section can be made by casting in similar molds or by machining etc. The transparent material may be threaded or have metal threaded inserts for tensioning the flexible upper and lower limbs and for arrow rests and stabilizers.

I have described my invention with respect to the presently preferred embodiment as required by the patent statutes. Various modifications, improvements and variations will occur to those skilled in the art. All such modifications, improvements and variations that come within the true spirit and scope of the invention are included within the scope of the attached claims.

I claim:

1. An archery bow having a structural riser made of transparent material and having forward and rear surfaces that are flat and parallel to each other.

2. An archery bow having a riser portion made of transparent material, said riser portion having forward and rear surfaces and right and left side surfaces characterized by:

(a) said forward and rear surfaces being flat and parallel to each other and sufficiently optically flat to produce an undistorted view of subject matter through said front and rear surfaces; and (b) said side surfaces being flat and converging to align generally with a vertical line at a user's eye at full draw of the bow, in order that said side surfaces are invisible to an aiming eye of said user at full draw of the bow.

3. In an archery bow comprising an upper riser portion and lower shank portion integrally connected thereto, and upper and lower flexible limbs connected, respectively, to an upper end of said riser portion and a lower end of said shank portion, a hand grip portion situated generally adjacent a transition between said shank and riser portions, and a bow string spanning generally between tips of said flexible limbs, the improvement comprising:

said riser portion comprising a transparent material so as to provide an undistorted and unobstructed field of view therethrough during use and providing an only direct structural connection between said shank and said upper flexible limb.

4. An improvement as in claim 3, and further comprising:

said riser portion being sufficiently wide to extend into a sighting line by which a user aims an arrow at a target during use of said bow; and sighting indicia situated on said riser and viewable therethrough along said sighting line.

5. An improvement as in claim 4, and further comprising:

said sighting indicia being marks spaced along a length of said riser portion, said marks being indicative of different distances to said target.

* * * * *